United States Patent [19]

Woo et al.

[11] Patent Number: 5,005,485

[45] Date of Patent: Apr. 9, 1991

[54] POWER BOOSTER BUSHING

[75] Inventors: Kenneth J. Woo, Manchester; Robert K. Annan, Merrimack, both of N.H.

[73] Assignee: Burndy Corporation, Norwalk, Conn.

[21] Appl. No.: 483,904

[22] Filed: Feb. 22, 1990

[51] Int. Cl.[5] ..... C06D 5/00

[52] U.S. Cl. ..... 102/531; 102/469

[58] Field of Search ..... 102/469–472, 102/447, 531, 530, 466, 467, 532

[56] References Cited

U.S. PATENT DOCUMENTS

| | | | |
|---|---|---|---|
| 3,359,906 | 12/1967 | Herter | 102/469 |
| 3,590,740 | 7/1971 | Herter | 102/469 |
| 3,611,870 | 10/1971 | Udert et al. | 102/530 |
| 4,722,189 | 2/1988 | Center | 60/635 |

FOREIGN PATENT DOCUMENTS

| | | | |
|---|---|---|---|
| 1537421 | 8/1968 | France | 102/469 |

*Primary Examiner*—Harold J. Tudor

*Attorney, Agent, or Firm*—Burtsell J. Kearns; Patrick J. Walsh

[57] ABSTRACT

A power booster bushing for obturating powder gases in a cartridge case employed by power actuated tools used for connecting power cables. The power booster bushing supports an explosive power cell and is slidably positioned in the cartridge case bore and has a series of ribs defined by grooves engaging the cartridge case bore. The interface between the cartridge case bore and the bushing is sealed during detonation of the power cell by means of the circumferential ribs. The bushing undergoes an "accordion effect" during detonation characterized by axial compression of the bushing and resulting in the prevention of powder gas escape through the open breech end of the cartridge case.

3 Claims, 3 Drawing Sheets

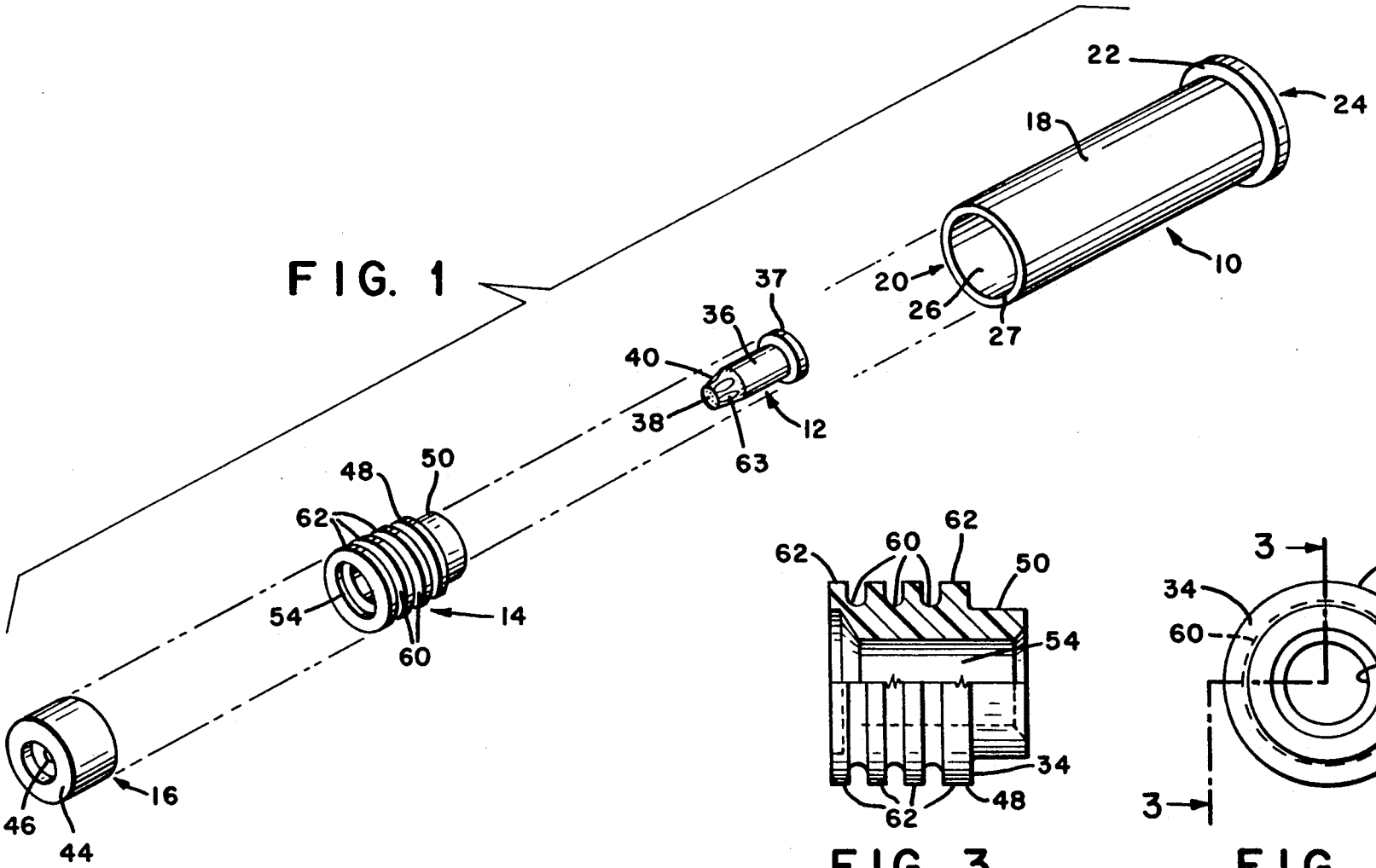
FIG. 1
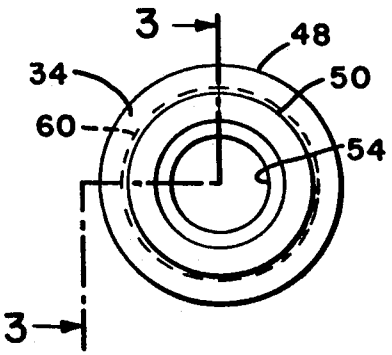
FIG. 2
FIG. 3

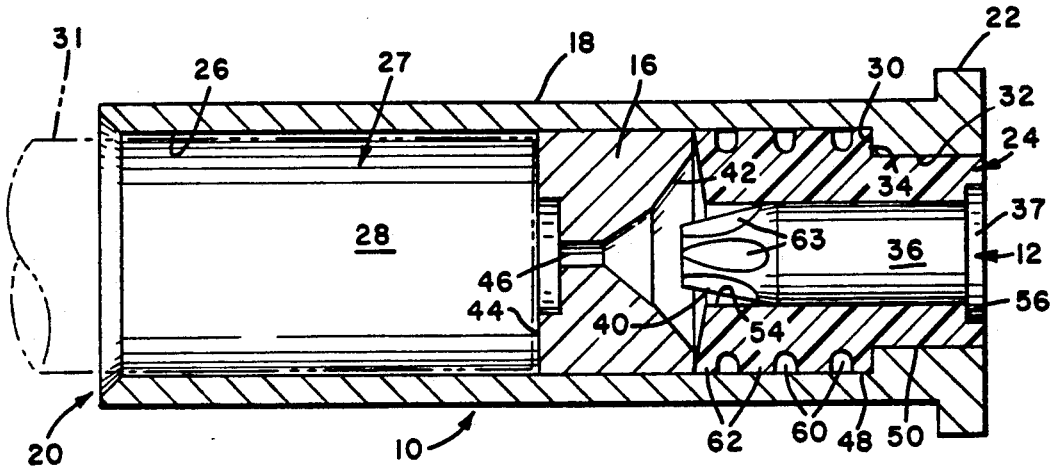
FIG. 4 (BEFORE FIRING)
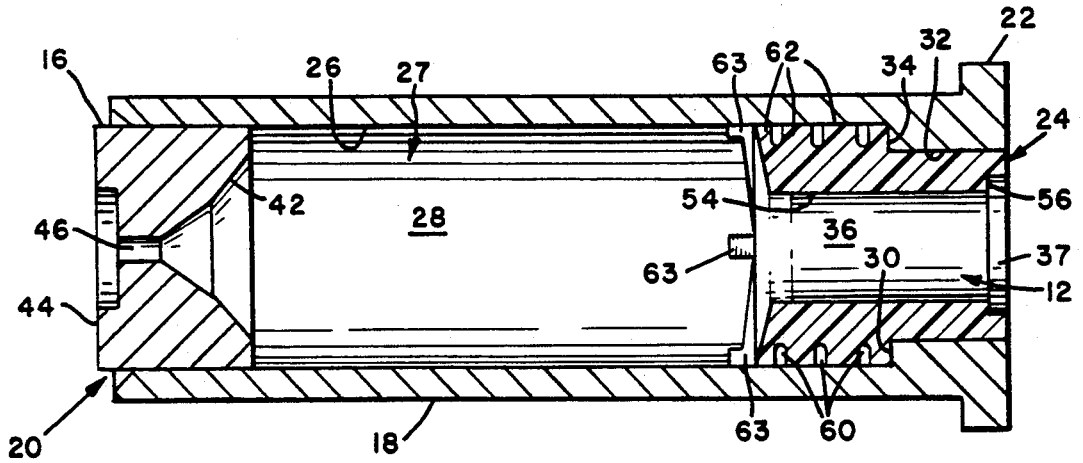
FIG. 6 (AFTER FIRING)

(BEFORE FIRING)

(AFTER FIRING)

POWER BOOSTER BUSHING

BACKGROUND OF THE INVENTION

The present invention relates to power booster cartridges employed by power activated tools for fitting connectors to power cables and, in particular, to a power booster bushing for receiving and positioning a power cell within the power booster cartridge.

U.S. Pat. No. 4,722,189 assigned to Burndy Corporation is directed to an explosively operated tool for connecting a tap or branch cable to a permanently installed main power cable. The power tool uses an explosive charge or power cell which generates sufficient force to drive a wedge into a sleeve connection between the main cable and tap wire.

The power cell described in U.S. Pat. No. 4,722,189 includes a tubular cartridge case, a rim fire power cell held by a supporting collar or power booster bushing slidably fitted in the cartridge case, and a power piston slidably fitted in the cartridge case ahead of the power cell for transmitting explosive force during operation of the power tool. The cartridge case has openings both at its muzzle and breech ends. According to the '189 patent, the power tool is armed when its power ram is inserted into the open muzzle end of the cartridge case as the power tool engages an unfinished connector and the power ram pushes the power piston and power booster bushing with power cell rearwardly so that the power cell is positioned at the open breech end of the cartridge case within range of the firing pin.

Because of the sliding interface between the power booster bushing and the cylindrical interior surface of the cartridge case there is an opportunity for migration of powder gases rearwardly past the interface and outwardly through the breech opening when the power cell is detonated. Such power gas migration tends to diminish the power available for actuating the power tool. Additionally, the powder gases cause erosion of the power tool's breech plug mechanism carrying the firing pin.

SUMMARY OF THE INVENTION

The present invention is directed to a power booster bushing having an exterior configuration for purposes of creating a gas-tight seal at the interface between cartridge case at its open breech end and the power booster bushing so as to obturate power gases tending to migrate outwardly of the breech end of the cartridge case. As a result, there is an increase in power delivered to the power ram of the power tool. Additionally, there is a reduction in the extent of wear of the breech plug mechanism caused by powder gases.

According to a preferred embodiment of the invention, the power booster bushing has a generally cylindrical shape with an internal bore for receiving the powder containing power cell aligning it axially of the cartridge case and positioning its rim end at the breech opening of the cartridge case in striking range of the firing pin when the power tool is armed. The generally cylindrical exterior surface of the power booster bushing engaging the inner surface of the cartridge case is provided with one or more circumferential grooves defining a plurality of ribs on the outer surface of the booster bushing for the purpose of obturating powder gases.

When the power cell is detonated the powder gases drive the power piston and the power ram toward the muzzle end of the cartridge case inducing a reaction force on the front face of the power booster bushing which collapses the bushing along its central axis with the circumferential ribs tightly engaging the interface of the cartridge case to prevent migration of gases rearwardly past the bushing/cartridge case interface and preventing the escape of gases through the breech end of the cartridge case.

OBJECTS OF THE INVENTION

It is an object of the invention to provide a power bushing for obturating powder gases in a power booster cell.

It is a further object of the invention to provide a power booster bushing for a cartridge case having an open breech end in which the bushing slidably positions a power cell at the open breech end and in which the bushing collapses axially during detonation of the power cell in order to prevent migration of powder gases rearwardly of the bushing and out the open breech end.

Other and further objects of the invention will occur to those skilled in the art upon an understanding of the specification or on employment of the invention in practice.

DESCRIPTION OF THE DRAWING

A preferred embodiment of the invention has been chosen for purposes of description and is shown in the accompanying drawing in which:

FIG. 1 is an exploded perspective view of a power booster cartridge including the power booster bushing of the present invention.

FIG. 2 is a view of the breech end of the power booster bushing shown in FIG. 1.

FIG. 3 is a side view of the power booster bushing partially cut away along line 3—3 of FIG. 2 to illustrate its construction.

FIG. 4 is a sectional view of the power cell before firing.

FIG. 6 is a section view of the booster cell after firing.

Figure 5:
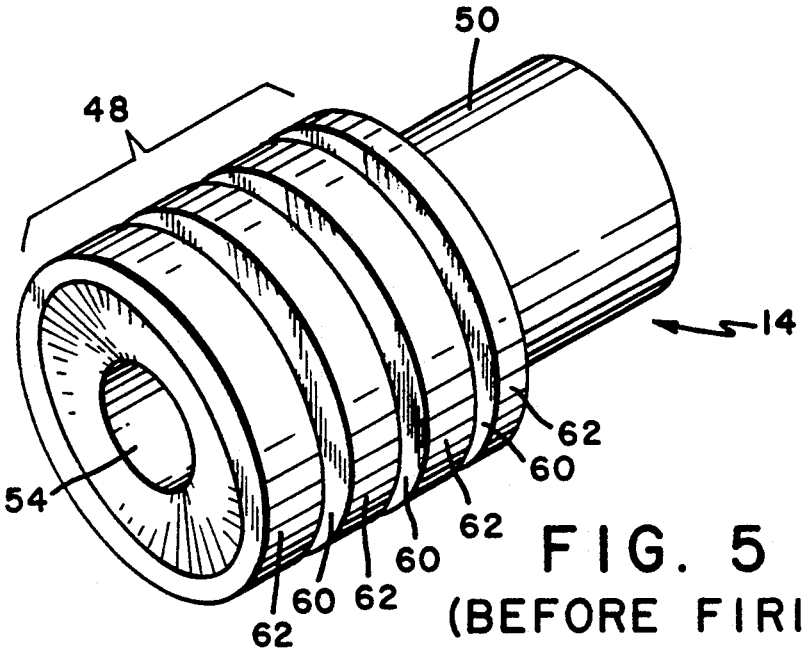
FIG. 5 is a perspective view of the power bushing before firing.

Referring now to the drawing, the power booster according to the present invention includes a cartridge case 10, a power cell 12, a power booster bushing 14 and a power piston 16 shown in FIG. 1. The cartridge case as best shown in FIGS. 1 and 4, is of known construction and includes a hollow cylindrical casing 18 with an open muzzle end 20 and a flanged 22 open breech end 24 for positioning the power cell and booster bushing at the breech end of the cartridge case. The inner surface 26 of the cartridge case bore 27 is generally cylindrical defining a forward cartridge chamber 28 extending from the open muzzle end to an annular shoulder 30 adjacent the breech end for receiving the bushing 14 and power cell 12, the power piston 16 and the tool's power ram 31. The annular shoulder 30 defines a rear cartridge chamber 32 of lesser diameter extending to the breech opening for receiving the power booster bushing and positioning the power cell in the breech opening within striking range of the tool's firing pin (not shown). The annular shoulder 30 of the cartridge case cooperates with a corresponding shoulder 34 on the bushing for the purpose of locating the power cell precisely at the breech end of the cartridge case as the power tool is armed and also for retaining the bushing in the cartridge case when the power cell is detonated.

The power cell 12 is of known construction and includes a metallic, preferably brass, casing 36 filled with a powder charge 38 and having a conical tip 40 for directing the powder gases and their explosive force axially of the cartridge case during detonation. The power cell tip is fluted along its surface and crimped in a known manner to confine the powder charge. Detonation occurs when the firing pin (not shown) strikes the power cell rim 37.

The booster case also includes a power piston 16 of known construction which engages the power ram 31 of the power tool for driving the power ram and actuating the tool during operation. Powder gases act on the beveled rear face 42 of the powder piston while the front face 44 engages the power ram driving it forward during tool operation. A central port 46 allows for escape of spent powder gases through the power piston.

The power booster bushing 14 has a generally cylindrical shape of greater 48 and lesser 50 diameters defined by a radially extending shoulder 34. The rear portion of the bushing, as noted above, cooperates with the breech shoulder 30 of the cartridge case for positioning the power cell and for maintaining the bushing in position when the power cell is detonated. The bushing further includes an axial bore 54 for accommodating the power cell and an annular recess 56 at its breech end to accommodate the rim 37 of the booster cell allowing for ease of assembly of power cell and booster bushing while precisely locating the booster cell rim at the breech end for purposes of detonation and restraining the power cell against forward movement when struck by the firing pin.

Figure 7:
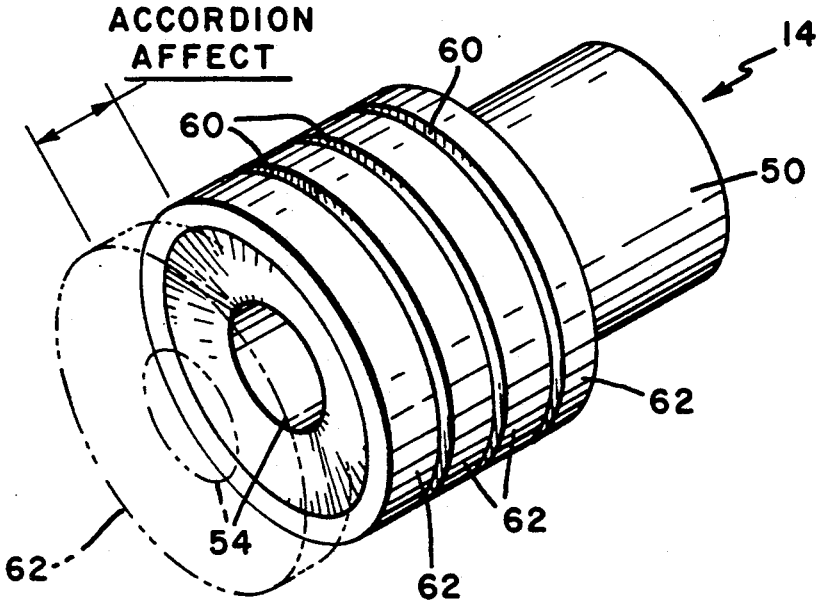
FIG. 7 is a perspective view of the booster bushing after firing.

The greater diameter 48 of the booster bushing includes a plurality, preferably three grooves 60 extending circumferentially of the greater diameter surface and spaced axially from each other. The grooves define a plurality of ribs 62, preferably four, in the preferred embodiment along the interface of the cartridge case bore. The ribs thus formed act to obturate powder gases when the power cell is fired. Additionally, the grooves enable the bushing to collapse axially, as shown in FIGS. 5 and 6, as an aid in obturating the powder gases. As the power cell detonates the powder gases first through the power cell flutes 63 and drive the power piston forward thereby inducing a reaction force against the front face of the bushing which causes the booster to collapse in an axial direction. The collapsing of the booster bushing causes an accordion effect thereby creating a gas-tight seal between the greater diameter outer wall and the adjacent inner surface of the booster case. The relative condition of the power bushing is shown before firing in FIG. 5 and after firing in FIG. 7.

The power booster bushing can be made of any suitable material and in a preferred embodiment is fabricated of high density polyethylene with natural color and using virgin material. Other materials found suitable are nylon, GE LOMOD (TM), Dupont's Zytel (TM), and GE Xenoy (TM). Each rib is about 0.050 inches wide having a height of 0.067 inches. The rear most rib is somewhat wider and has a width of 0.082 inches.

In the preferred embodiment of the invention using a cartridge case of known dimensions there is a reduction in an axial length of the booster bushing, i.e., the accordion effect, of approximately 0.070 to 0.100 of an inch. For a booster bushing initially 0.655 inches in length there is a reduction in length of approximately 10–15%.

Having thus described the invention, we claim:

1. A power booster for power activated tools comprising a cartridge case having a tubular wall with open muzzle and breech ends, a booster bushing and a power cell with a firing rim subassembly slidably fitted into the cartridge case, and a power piston in the cartridge case ahead of the subassembly, the cartridge case having a generally cylindrical inner surface divided by a radially extending shoulder into a forward cartridge chamber and a rear cartridge chamber, the booster bushing being generally cylindrical and having an outer surface of greater and lesser diameters defined by a radially extending shoulder, the bushing having an axial bore for receiving the power cell, the bushing being slidably fitted into the cartridge case with its lesser diameter portion received by the rear cartridge chamber positioning the power cell rim at the open breech end of the cartridge case, and with the greater diameter portion of the bushing fitted in the forward cartridge chamber with radial shoulders of cartridge case and bushing in abutting relation and with the front end of the power cell in confronting relationship with the power piston, the greater diameter portion of the bushing having a plurality of grooves on its outer surface defining a forward series of ribs thereon having annular flat surfaces and a rear rib wider than forward ribs for accommodating axial collapse of the greater diameter portion of of the bushing against the cartridge case shoulder for obturating power cell gases tending to flow past the outer surface of the bushing and out the open breech end when the cartridge case is fired.

2. A power booster bushing as defined in claim 1 in which the rear cartridge chamber inner surface and the booster bushing lesser diameter outer surface are smooth.

3. A power booster bushing as defined in claim 1 in which the forward ribs are approximately 0.05 inches wide and the rear rib is approximately 0.082 inches wide.

* * * * *